US006153880A

United States Patent [19]

Russ, IV et al.

[11] Patent Number: 6,153,880

[45] Date of Patent: Nov. 28, 2000

[54] METHOD AND APPARATUS FOR PERFORMANCE IMPROVEMENT OF MASS SPECTROMETERS USING DYNAMIC ION OPTICS

[75] Inventors: Charles William Russ, IV, Sunnyvale; Jerry T. Dowell, Portola Valley; Steven M. Fischer, Hayward, all of Calif.

[73] Assignee: Agilent Technologies, Inc., Palo Alto, Calif.

[21] Appl. No.: 09/410,379

[22] Filed: Sep. 30, 1999

[51] Int. Cl.[7] ..... H01J 49/42

[52] U.S. Cl. ..... 250/292

[58] Field of Search ..... 250/292, 293, 250/291, 290, 281, 282

[56] References Cited

U.S. PATENT DOCUMENTS

| | | | |
|---|---|---|---|
| 3,129,327 | 4/1964 | Brubaker | 250/41.9 |
| 3,147,445 | 9/1964 | Wuerker et al. | 330/4.7 |
| 3,371,204 | 2/1968 | Brubaker | 250/41.9 |
| 3,555,271 | 1/1971 | Brubaker et al. | 250/41.9 |
| 3,560,734 | 2/1971 | Barnett et al. | 250/41.9 |
| 3,617,736 | 11/1971 | Barnett et al. | 250/41.9 |
| 3,783,279 | 1/1974 | Brubaker | 250/292 |
| 3,867,632 | 2/1975 | Fite | 250/292 |
| 3,936,634 | 2/1976 | Fite | 250/281 |
| 3,937,954 | 2/1976 | Fite | 250/282 |
| 4,013,887 | 3/1977 | Fite | 250/282 |
| 4,066,894 | 1/1978 | Hunt et al. | 250/292 |
| 4,075,479 | 2/1978 | Reeher et al. | 250/281 |
| 4,132,892 | 1/1979 | Wittmaack | 250/309 |
| 4,682,026 | 7/1987 | Douglas | 250/288 |
| 4,695,724 | 9/1987 | Watanabe et al. | 250/292 |
| 4,736,101 | 4/1988 | Syka et al. | 250/292 |
| 4,755,670 | 7/1988 | Syka et al. | 250/292 |
| 5,559,337 | 9/1996 | Ito et al. | 250/423 |
| 5,572,022 | 11/1996 | Schwartz et al. | 250/282 |
| 5,663,560 | 9/1997 | Sakairi et al. | 250/281 |
| 5,734,162 | 3/1998 | Dowell | 250/292 |
| 5,739,530 | 4/1998 | Franzen et al. | 250/288 |
| 6,028,308 | 2/2000 | Hager | 250/292 |

FOREIGN PATENT DOCUMENTS

| | | |
|---|---|---|
| 61-82653 | 4/1986 | Japan . |
| 08045468 | 7/1994 | Japan . |

OTHER PUBLICATIONS

P. Marmet, Quadrupole Mass Analyzers; Journal of Vacuum Science and Technology, vol. 8 No. 1 262, 1971.

A. E. Holme, W. J. Thatcher, The Dependence of Ion Transmission On the Initial r.f. Phase of A Quadrupole Mass Filter; 10, 271–277, 1972–1973.

Peter H. Dawson, American Vacuum Society Classics, Quadrupole Mass Spectrometry and Its Applications; Chapter II, Table and pp. 9–64, 1976.

Hermann Wollnik, Optics of Charged Particles; Chapter 3, 1987.

*Primary Examiner*—Kiet T. Nguyen

[57] ABSTRACT

A mass spectrometer method and apparatus improve resolution and sensitivity. A voltage supply is coupled to a mass filter for applying a radio frequency voltage and for operating at at least one selected frequency. An ion optical element such as an entrance lens is driven by a voltage supply that is phase coherent with the voltage applied to the mass filter. The ion beam is tailored so that the phase space relationship of the ions is more closely matched to the acceptance of the mass filter. The ions in the incoming beam are dynamically matched to the acceptance of the mass filter over each cycle of the voltage applied to the mass filter. The ion optical element may be a single entrance lens to which is applied only a single phase coherent voltage.

49 Claims, 12 Drawing Sheets

METHOD AND APPARATUS FOR PERFORMANCE IMPROVEMENT OF MASS SPECTROMETERS USING DYNAMIC ION OPTICS

BACKGROUND OF THE INVENTIONS

1. Field of the Invention

These inventions relate to mass spectrometers, for example quadrupole mass filter spectrometers.

2. Related Art

Mass spectrometers are used in atomic and chemical analysis to determine the quantity and atomic or chemical makeup of unquantified or unknown atoms and compounds. There are a number of different types of mass spectrometers, but the following discussion will focus on quadrupole mass spectrometers as a particular application of the inventions to spectrometers. One or more of the inventions could be applicable to other mass spectrometers, including multi-pole spectrometers.

A quadrupole mass spectrometer system generally consists of a source of ions, a quadrupole mass filter, an ion detector and associated electronics. A gaseous, liquid or solid sample is ionized in the ion source and a portion of the ions created in the ion source is injected into the quadrupole mass filter. The filter rejects all ions except those in a selected mass-to-charge ratio (mass/charge) range as determined by the system electronics. (It will be understood from the context herein where the references to mass without mentioning charge refer to the mass-to-charge ratio, as appropriate, even though charge is not specifically expressed, because the effect of the field depends on the charge of the ions.) That selected mass range is usually less than 1 atomic mass unit (AMU) centered at a particular mass. Because the masses of the elements making up the sample are often unknown, the system varies the mass range from a starting mass number to an ending mass number to test for and sense particles having the masses within the mass range selected. The mass range can be as low as one AMU up to thousands of AMU. The system operates either automatically or under manual control. The mass analysis of the composition of the sample is performed by rapidly scanning the DC and RF voltages, or the frequency of the RF voltage, on the quadrupole filter, thereby scanning through the possible masses and recording the abundance of each as transmitted through the filter.

The effectiveness of a mass spectrometer system is determined in large part by its sensitivity and selectivity, the latter usually being called resolution. Sensitivity determines how small a quantity of sample can be detected and its constituents quantified. Resolution must be sufficient for two adjacent mass peaks to be clearly separated such that their separate characteristics can be determined.

A conventional quadrupole mass filter consists of four conductive rods arranged with their long axes parallel to a central axis and equidistant from it. The cross sections of the rods are preferably hyperbolic, although rods of circular cross section ("round rods") are common. Round rods will be referred to and shown for simplicity, but it should be understood that other conventional rods are equally applicable. To select which ions are rejected and which are passed through the mass filter, a selectable voltage $\pm(U+V\cos\omega t)$ is applied on adjacent rods, so that opposite rods have the same potential and adjacent rods have equal but opposite potentials. U is the DC or offset voltage and V is the radio frequency (RF) component of the voltage applied to the quadrupole rods, at a given frequency $\omega$ and time t. The field created within the region surrounded by the rods is a quadrupole field, with the electric field sensed by the ions travelling between the rods directly proportional to the distance from the central axis.

Ions injected into the entrance of the filter will exhibit oscillatory trajectories generally in the direction of the central axis (Z-axis). Those ions that oscillate too far from the central axis (in the X-axis and/or in the Y-axis directions) will, in general, not pass through the filter, while those ions that exhibit relatively short oscillatory trajectories pass from the exit of the filter and are detected. The extent of the oscillatory trajectories for a given ion mass is determined by the selected voltage. The selected voltage comes from a certain set of pre-determined voltages that are a function of the mass of the ions. The pre-determined voltages are typically developed empirically for the particular mass spectrometer configuration, and are stored in a computer or other processor memory as a look up table or equation for use during operation of the system. The magnitudes and ratio of the DC and RF components of the applied voltage can be adjusted such that only a very narrow mass range of ions will pass through the device. The narrower the mass range of the ions passing through the device, the higher the resolution, and the easier it is to distinguish ions of similar masses. Sweeping the RF voltage with a fixed RF/DC ratio will result in a mass spectrum over the range of masses selected for analysis.

The resolution of the mass filter can be increased by decreasing the RF/DC voltage ratio, at least until a ratio is reached such that ions are no longer transmitted through the filter. However, as resolution is increased the ion transmission decreases. The transmission is the fraction of input ions of the same mass that make it through the filter. With lower transmission, the amount of the sample becomes more important and it may be more difficult to quantify the results for each mass peak in a spectrum. The resolution achievable depends on the mass of the ion and the length of the mass filter, and the transmission depends on the resolution and the input conditions of the ions, i.e., on the positions and velocities of the ions as they enter the filter. Other factors affect the operation of the mass filter, such as fringe fields at the ends of the mass filter, the presence or absence of focusing elements, and the voltages that may be applied to these focusing elements. While many of these factors are understood, there is still room for improvement in the resolution and sensitivity of mass filter spectrometers.

One area of improvement is in the transmission of the ions for a given resolution, or conversely increasing the resolution while still ensuring a desired level of transmission. Because of the number of ions that are lost before and after entering the mass filter, analysis often uses more time and/or larger samples to achieve the desired results. It is well understood that ions traveling along the central axis (Z-axis) or not very far off the axis are easily transmitted through the quadrupole mass filter. However, the loss often occurs near the entrance to the quadrupole mass filter due to ions not having the required properties of position and velocity to match the electric field of the quadrupole mass filter existing at the time the ion approaches it. One reason may be that the ion starts too far away from the central axis to be brought back before it collides with the rods of the quadrupole mass filter. Another reason may be that the ion's velocity moving away from the central axis is too great to be brought back to the axis of the quadrupole mass filter by the effects of the electric field. Moreover, the electric field that might bring an ion into the mass filter varies over time, as can be seen from the expression $\pm(U+V \cos \omega t)$ . The variation is sinusoidal with a frequency $\omega$, which can be in the megaHertz range, so at one time an ion with a given position and velocity may make it into the mass filter but not at another time less than a millionth of a second later or earlier. Only half a cycle or a full cycle later will an ion of the same position and velocity be able to pass through the mass filter. At a given time, the ion positions and velocities that will gain them entrance to the mass filter are depicted in the FIGS. 3 and 4, and ions having positions and velocities outside the particular ellipse corresponding to the applicable time are lost. Therefore, ion transmission and/or mass filter resolution are lower than desired.

SUMMARY OF THE INVENTIONS

An apparatus and method are described for improving mass spectrometers, such as quadrupole mass filter spectrometers, by improving resolution without decreasing transmission and/or improving transmission without decreasing resolution. Existing equipment can be easily retrofitted to incorporate the apparatus of the present inventions, and the cost of incorporating one or more of the elements of the present inventions is significantly less than many types of upgrades that improve either ion transmission or resolution. The inventions can be implemented in a number of different types of ion input optics with similar results. The present inventions can be used to increase the sensitivity of conventional quadrupole mass filter spectrometers by a significant amount, e.g., a factor of 2.5 in one embodiment.

In accordance with one aspect of the present inventions, a mass spectrometer includes a mass filter, a quadrupole or other device having an input and an output and a voltage supply for applying a voltage. An ion optical element is positioned between a source of ions and the mass filter and includes a voltage supply. The voltage supply for the ion optical element is preferably phase coherent and may be phase locked with or otherwise related to the voltage applied to the mass filter. By making the voltage phase coherent, the ion characteristics can be tailored to match the dynamic phase space of the mass filter so that more of the ions of the desired mass are transmitted through the mass filter. The ions are transported to the mass filter and injected in an optimal fashion so as to increase the transmission of those ions through the filter. The apparatus and method also preferably include the capability of adjusting or changing the voltage applied to the ion optical element, in terms of any of a DC component, RF component, phase and the like. The capability to adjust or change can be manual but is preferably processor implemented or controlled either through manual input, software or firmware control or through feedback from appropriate sensors, or the like. The capability is also well suited to be applied as a function of mass, to optimize to the mass/charge ratio, especially when scanning over a range of mass/charge ratios.

In accordance with one aspect of one of the present inventions, the mass filter is a quadrupole mass filter and the ion optical element is an entrance lens, which extends at least partly into the quadrupole mass filter. Such an entrance lens may insulate the beam somewhat from the effects of fringe fields generated in the quadrupole mass filter.

In accordance with a further aspect of one of the present inventions, the voltage supply for the ion optical element can provide a DC voltage and a time varying voltage at the same frequency as the voltage applied to the quadrupole mass filter and phase coherent with that voltage. Preferably, the time varying voltage can be applied with suitable amplitude and phase for changing the beam from converging to diverging over the cycle of the time varying voltage, to improve the acceptance of ions into the mass filter.

In accordance with another aspect of one of the present inventions, the time varying voltage is applied only to a single ion optical element, and the ion optical element is preferably positioned immediately adjacent the input of the mass filter. Applying the time varying voltage only to a single optical element simplifies the apparatus and reduces its cost. The ion optical element can be configured to accommodate any number of different mass filter designs and conventional ion optics with comparable results.

In a further aspect of one of the present inventions, the source of ions is a collision cell which may have its own multipole assembly. The ion optical element is positioned between the output of the collision cell and the quadrupole mass filter. The voltages applied to the ion optical element may be different where the trajectories of the ions coming from the collision cell are more or less uniform compared to other sources of ions.

In another aspect of one of the present inventions, the ion optical element includes a quadrupole lens system having a time varying voltage applied to it at the same frequency as the voltage applied to the quadrupole mass filter and phase coherent with that voltage. The quadrupole lens may also include an accelerating lens system upstream from the quadrupole lens, and a decelerating lens system down stream. Accelerating the ions in the accelerating lens system enhances the effects of the quadrupole lens system in tailoring the beam to the admittance of the quadrupole mass filter.

In a further aspect of one of the present inventions, a mass filter spectrometer is operated by applying a mass filter radio frequency voltage to a mass filter and applying a radio frequency voltage to an ion optical element. The two voltages are preferably phase coherent so that the ion beam can be tailored to more closely match the dynamic phase space of the mass filter. The voltages are also preferably applied at the same frequency.

These and other aspects of the present invention will be described in more detail below after a brief description of the drawings.

DETAILED DESCRIPTION OF THE PREFERRED EMBODIMENTS

The following specification taken in conjunction with the drawings sets forth the preferred embodiments of the present inventions in such a manner that any person skilled in the art can make and use the inventions. The embodiments of the inventions disclosed herein are the best modes contemplated for carrying out the inventions, although it should be understood that various modifications can be accomplished within the parameters of the present inventions.

The apparatus and methods of the present inventions improve the resolution and ion transmission of mass filter spectrometers. Ion optics preferably tailor the characteristics of the ion beam to dynamically match the phase space characteristics of the mass filter. The ion optics can be included in mass spectrometers with relatively little additional cost, and they can be used to easily retrofit existing systems. The ion optics can take a number of different configurations while still improving the resolution and/or transmission of present mass filter designs.

The following discussion will focus primarily on quadrupole mass filter spectrometers and how the apparatus and methods of the present inventions can be implemented in such spectrometers. It is believed that one or more aspects of the present inventions can be easily implemented in any number of different quadrupole mass filter configurations while still achieving the results obtained in the quadrupole mass filter configuration described herein. It is also believed that one or more aspects of the present inventions can be implemented in other mass filter configurations, e.g., monopoles, with comparable results. Additionally, one or more aspects of these methods and apparatus can be implemented in other mass spectrometers to achieve one or more similar results. However, it should be understood that this specification will focus on preferred applications of the inventions as they may be implemented on quadrupole mass filter spectrometers for tailoring the ion beam to more closely match the desired ion phase space configuration to the admittance of a quadrupole mass filter.

Figure 1:
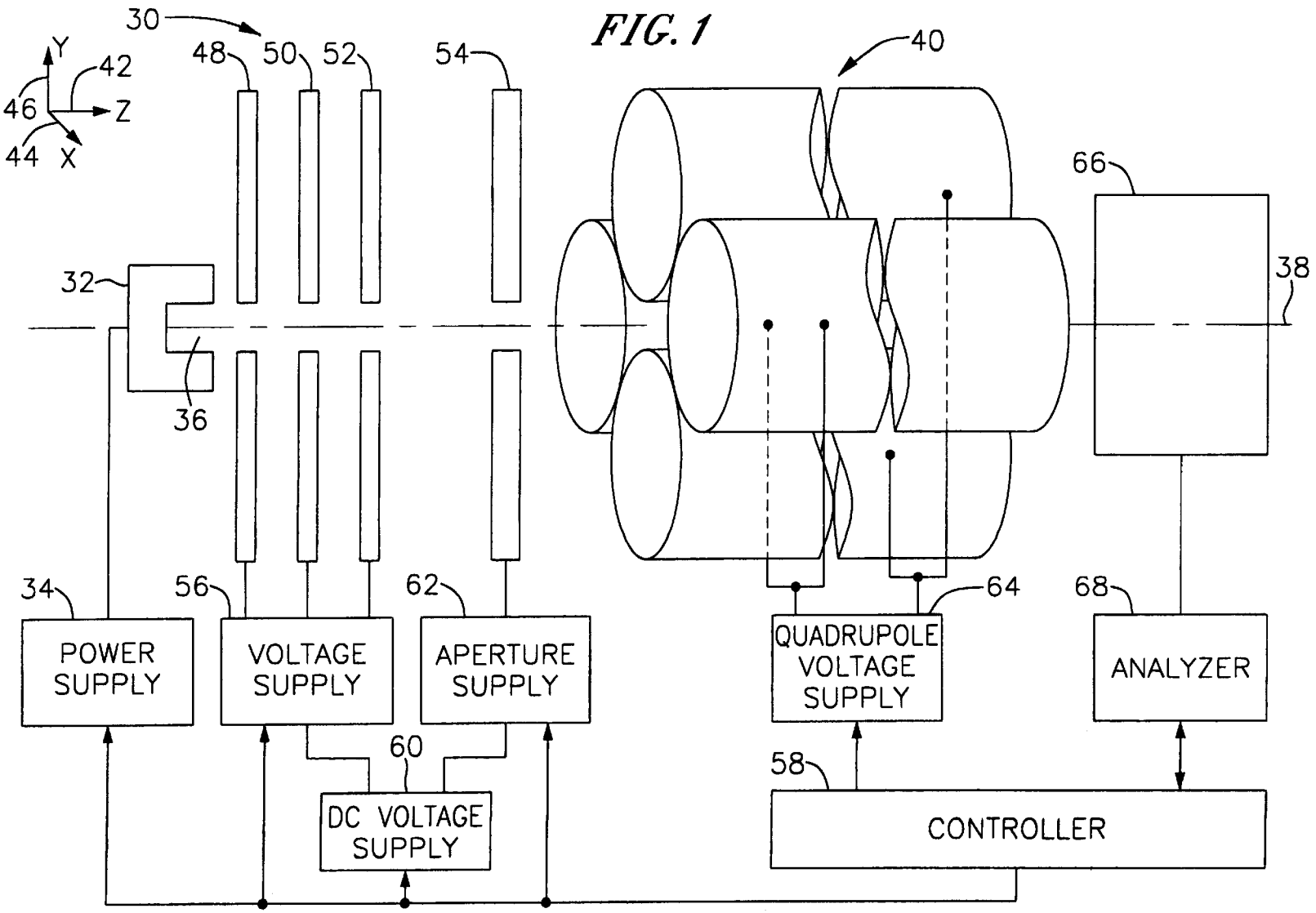
FIG. 1 is a schematic and partial block diagram of a quadrupole mass filter spectrometer of a conventional design.

A typical mass filter spectrometer 30 (FIG. 1) includes a source of ions 32 driven by a suitable power supply 34 for ejecting ions from the opening 36 in the source 32. The source of ions can be any number of devices, including electron impact, atmospheric pressure chemical ionization, inductively coupled plasma, electro-spray or a collision cell of a triple quadrupole. However, certain ion beam sources would function better with dynamic matching than others. A slit-shaped beam, such as can be produced by ionization with an electron beam, oriented along the x-axis can be advantageous. Preferably, the ion beam is highly mono-energetic, such as those that are produced by electro-spray and API ion sources and by electron impact ionization sources that have small, well-defined ionization regions and well-designed exit optics. However, the apparatus and methods of the present inventions are not restricted to a particular source of ions.

While the ions are ejected in a number of directions and with a range of velocities, they are traveling generally in the direction of the central axis 38 of the quadrupole mass filter 40. The central axis 38 is generally considered the Z-direction represented at 42. Many ions are headed in directions off the Z-axis more or less also in the directions of the X-axis and the Y-axis, respectively identified with reference numbers 44 and 46.

The quadrupole mass filter spectrometer also includes ion optics to reposition or redirect the ions toward the quadrupole mass filter 40 and along the central axis 38. The ion optics may include one or more electrodes 48, 50 and 52 for redirecting and/or repositioning ions in the ion beam, and possibly an entrance aperture 54 which may be included to reduce the effects of fringe fields at the entrance end of the quadrupole mass filter 40. Each of the electrodes 48, 50 and 52 have voltages applied to them through one or more voltage supplies 56, which in turn may be supplied by a D.C. voltage supply 60. Voltage supply 56 may provide discrete and separate voltages to each of the individual electrodes or may provide the same voltage to each. Voltage supply 56 may be controlled and operated by a controller 58 or other apparatus. The entrance aperture 54 may also have a voltage on it as determined by an aperture supply 62, which in turn can be supplied by the D.C. voltage supply 60 and controlled by a controller or other suitable apparatus.

The quadrupole mass filter 40 can take any number of configurations known to those skilled in the art such as the Hewlett-Packard HP G1946 (LC/MSD). The mass filter is driven by a suitable quadrupole voltage supply 64, which may be controlled by a suitable controller such as a microprocessor programmed with control software and data sufficient to allow the quadrupole mass filter to scan ions having masses coming within the range specified for the mass filter spectrometer. As is known, the quadrupole mass filter filters out ions outside the mass range of interest and transmits ions within the selected range to an ion collector 66 to be analyzed by an analyzer 68. The analyzer 68 may be controlled by and may output results to the controller 58.

As is also known, the quadrupole mass filter acts as a filter by creating an electric field between the poles to change the radial energy of the ions entering the quadrupole filter. Ions having the mass/charge of interest and traveling generally along the central axis 38 are transmitted through the electric field, while the electric field accelerates ions having other masses sufficiently to cause them to impact one of the poles or exit between a pair of adjacent poles. Ions that are not traveling along the central axis 38 will be transmitted or lost depending on their initial position and velocity at the time they enter the electric field. If the ions are too far from the central axis 38 or have a velocity which cannot be overcome by the electric field to bring the ions back toward the central axis 38, the ions will be lost.

The ions are accelerated through application of a time varying, radio frequency (RF) voltage that produces a varying electric field in the mass filter. Consequently, the position and velocity configuration of the ions that will get those ions through the mass filter is changing with time, but repeats at a frequency, $\omega$. For a given time and therefore for a giving electric field condition, the ion position and velocity configuration sufficient to get the ion through the mass filter is known as the mass filter acceptance. The mass filter acceptance can be considered as a position-velocity aperture for the incoming ions of a given mass/charge.

The acceptance of a quadrupole mass filter is that configuration of the electric field in the filter that will transmit ions having the selected mass/charge. The electric field adds energy to ions in the ion beam. However, because the ions do not always approach the quadrupole mass filter along its central axis traveling in a straight line, the ions in the ion beam will be affected differently by the electric field. Moreover, this electric field is a time varying field that results from the voltage signals applied to the quadrupoles to create the electric field. The electric field varies according to a frequency, $\omega$, identified above in the expression for the voltages applied to the rods of the quadrupole.

Considering the ion position-velocity condition in more detail, the ion input conditions can be described by the "phase space" of the ions. Phase space is the space of momentum and position, which can be considered in the context of an x-y coordinate system, i.e., the ordinate of the space for an ion of a given mass is its velocity and the abscissa is its position. The phase space for an ion is 6-dimensional, but it has a 2-dimensional projection of each coordinate, e.g., the space of $v_x$, x for the x-coordinate. The ensemble of ions in the beam incident on the mass filter entrance can then be represented by points in the phase space, each point corresponding to the instantaneous velocity and position of an ion.

Figure 3A:
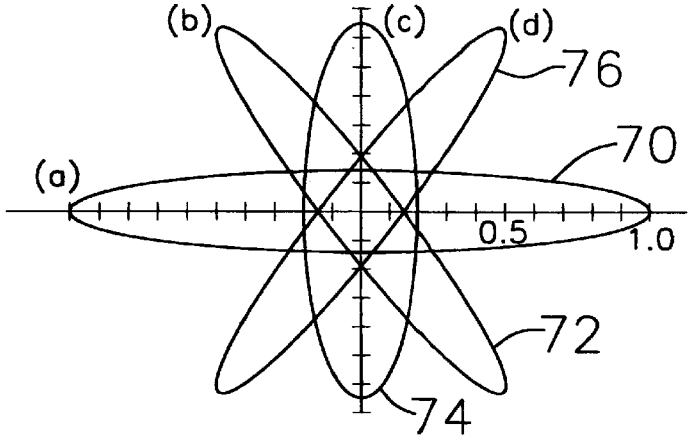
FIGS. 3A–C are graphical representations of phase space boundaries corresponding to three different characteristic frequencies of ion trajectories, wherein the phase space represents a combination of the position and the velocity of an ion for a given phase.
Figure 3B:
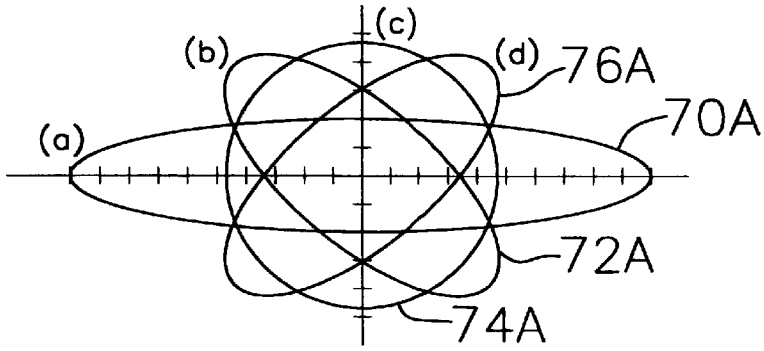
Figure 3C:
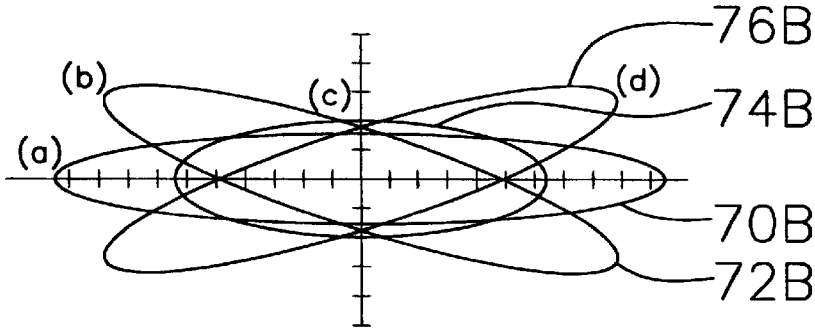

Whether or not an ion is transmitted through the filter, even if the voltages are such that their trajectory is stable, depends upon the maximum displacement of the trajectory. If the maximum displacement is greater than the distance from the central axis to the rods, the ion will strike a pole or rod and be lost. If the maximum displacement is less than that distance, then the ion will be transmitted, provided that the trajectory is nominally stable (a property that depends only on the applied voltages and the mass of the ion). For fixed entrance phase, or considering the phase at one point in time, the locus of points in phase space corresponding to a maximum displacement equal to $r_0$, the minimum distance from the central axis 38 to any rod, falls on an ellipse (FIGS. 3A–C). All points within such a phase space ellipse correspond to ions with initial positions and velocities that allow transmission through the filter, for a given phase of the RF voltage applied to the quadrupole mass filter.

FIG. 3A shows four ellipses, the first (a) ellipse 70 showing that for a given initial phase of zero, ions having a wide range of positions but only small velocities match the acceptance of the mass filter. The second (b) ellipse 72 corresponds to an initial phase of $-\pi/4$ and shows that a narrower range of positions but a wider range of ion velocities will match the acceptance of the mass filter. The third (c) ellipse 74 corresponds to an initial phase of $\pi/2$ and shows a wide range of velocities but a narrow range of positions will match the acceptance of the mass filter. The fourth (d) ellipse 76 corresponds to an initial phase of $\pi/4$.

The four ellipses of FIG. 3B are similar to those of FIG. 3A but correspond to a different characteristic frequency of the ions under consideration. The four ellipses of FIG. 3C are also similar, but correspond to a characteristic frequency different than those for FIGS. 3A and FIG. 3B. These graphical representations, as well as those in FIG. 4, were shown in Dawson, 1976, Quadrupole Mass Spectrometry And Its Applications, pp. 25 and 26.

Figure 4A:
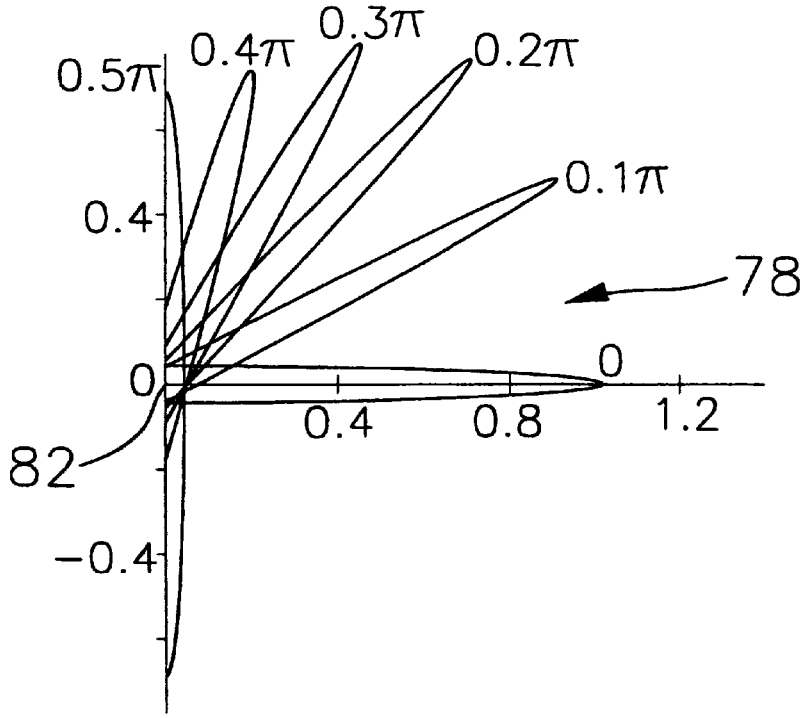
FIGS. 4A–B are graphical representations of acceptance ellipses for a mass filter for the x-axis and y-axis directions for a number of different initial phases.
Figure 4B:
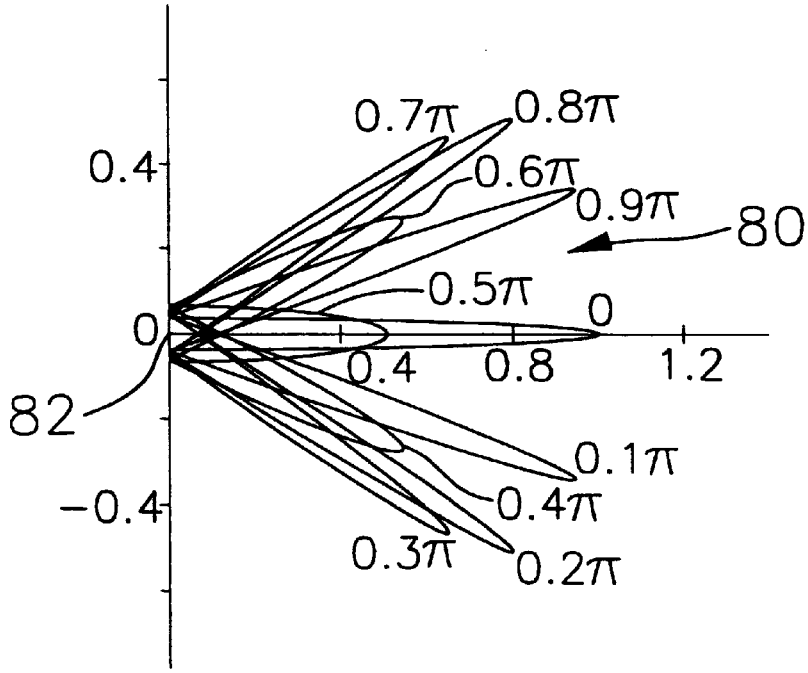

The ellipse with that property allowing transmission is called the acceptance of the filter for that particular phase. In general, the acceptance ellipse will change in size and orientation with change in input phase (FIGS. 3A–C) because the electric field is a time varying field. This phenomenon is shown for a fixed resolution and a set of input phases in FIG. 4. The x-phase space 78 is shown in FIG. 4A and the y-phase space 80 is shown in FIG. 4B. Initial phases from 0 to 0.5 pi are shown for the x-phase, and other phases are symmetric about the 0.5 pi phase. The x-axis is conventionally taken through the centers of the "positive" rods, i.e., those with positive applied DC voltage, and the y-axis is taken through the centers of the negative rods.

From these phase diagrams, approximate preferred beam characteristics can be developed. The Table 1 below relates the phase space ellipses in terms of the characteristics of the ion beam desired for preferred matching ("full aperture" means that x or y can be in the range $-r_o \leqq x \leqq r_o$, or $-r_o \leqq y \leqq r_o$, where $r_o$ is the field radius). The phase 45° corresponds to $\pi/4$, 90° to $\pi/2$, etc., with the other phases in the Table 1 in 45° increments.

TABLE 1

| Phase | Beam characteristics (fp= focal point) |
|---|---|
| | x-axis |
| 0° | Full aperture, ~ parallel |
| 45° | ≦0.5 $r_0$, divergent (fpin front of quadrupole) |
| 90° | Small aperture (<0.1 $r_0$), divergent (focus at entrance) |
| 135° | ≦0.5 $r_0$, convergent (fpin quadrupole) |
| 180° | Full aperture, ~ parallel |
| 225° | ≦0.5 $r_0$, divergent (fpin front of quadrupole) |
| 270° | Small aperture (<0.1 $r_0$), divergent (fpat entrance) |
| 315° | ≦0.5 $r_0$, convergent (fpin quadrupole) |
| | y-axis |
| 0° | ≦0.5 $r_0$, ~ parallel (Some ± Vy tolerance) |
| 45° | ≦0.7 $r_0$, convergent (fpin quadrupole) |
| 90° | Full aperture, ~ parallel |
| 135° | ≦0.8 $r_0$, diverging (fpin front of quadrupole) |
| 180° | ≦0.5 $r_0$, ~ parallel |
| 225° | ≦0.7 $r_0$, convergent (fpin quadrupole) |
| 270° | Full aperture, ~ parallel |
| 315° | ≦0.8 $r_0$, diverging (fpin front of quadrupole) |

When the fringing field at the quadrupole entrance is considered, the acceptance ellipses are different from those in the no-fringe field case, and they vary somewhat differently with phase. The variations depend upon the effective length of the fringe field. The basic principles of the invention still hold, however.

In conventional quadrupole mass spectrometers, ions from the ion source enter the mass filter continuously in time and they have a wide range of radial positions and transverse velocities. The effective transmission will thus be averaged over initial phases, since the ions will be distributed essentially evenly over the RF phase. The only part of the phase space that represents 100% transmission is that region 82 which is common to all the ellipses at all phases. As seen from FIGS. 4A and 4B, this is a very small region near the origin of the phase space diagram. In practice, the phase space area of ions emitted from an ion source may be much larger than the 100% acceptance area, so that many, if not most, of the ions entering the filter are lost, decreasing system sensitivity. Because the source phase space area (the so-called emittance) cannot be decreased by a lens system, only the shape of the ion distribution can be modified. (The phase space ellipses shown in FIGS. 4A–B are representative of a perfect quadrupole mass filter without fringing fields at the input or output. In reality, fringe fields at the input modify the acceptance ellipses in shape and position, but they still vary over time in shape and position with initial phase.)

To see how the phase space area of admittance for the quadrupole mass filter varies with time, consider the variation of the x-plane phase space ellipses with entrance phase as shown in FIGS. 3A–C. At zero phases, the acceptance ellipse includes the entire x-axis, but shows only small transverse velocity, termed here $\dot{x}$. A thin, parallel ion beam spread out along the x-axis and of width $2r_0$ has a phase space population that can match this acceptance ellipse. At $0.5\pi$ phase, however, the acceptance ellipse shows a spread of transverse velocity, but very little extent along the x-axis. A beam that is focused to a spot has a phase space ellipse that matches this acceptance. It is thus apparent that for optimum matching in the x phase space, the first and third quadrants of RF phase admit a diverging ion beam incident on the quad whereas the second and fourth admit a converging beam. Matching in the y-phase space is similar, but different in detail.

Figure 2:
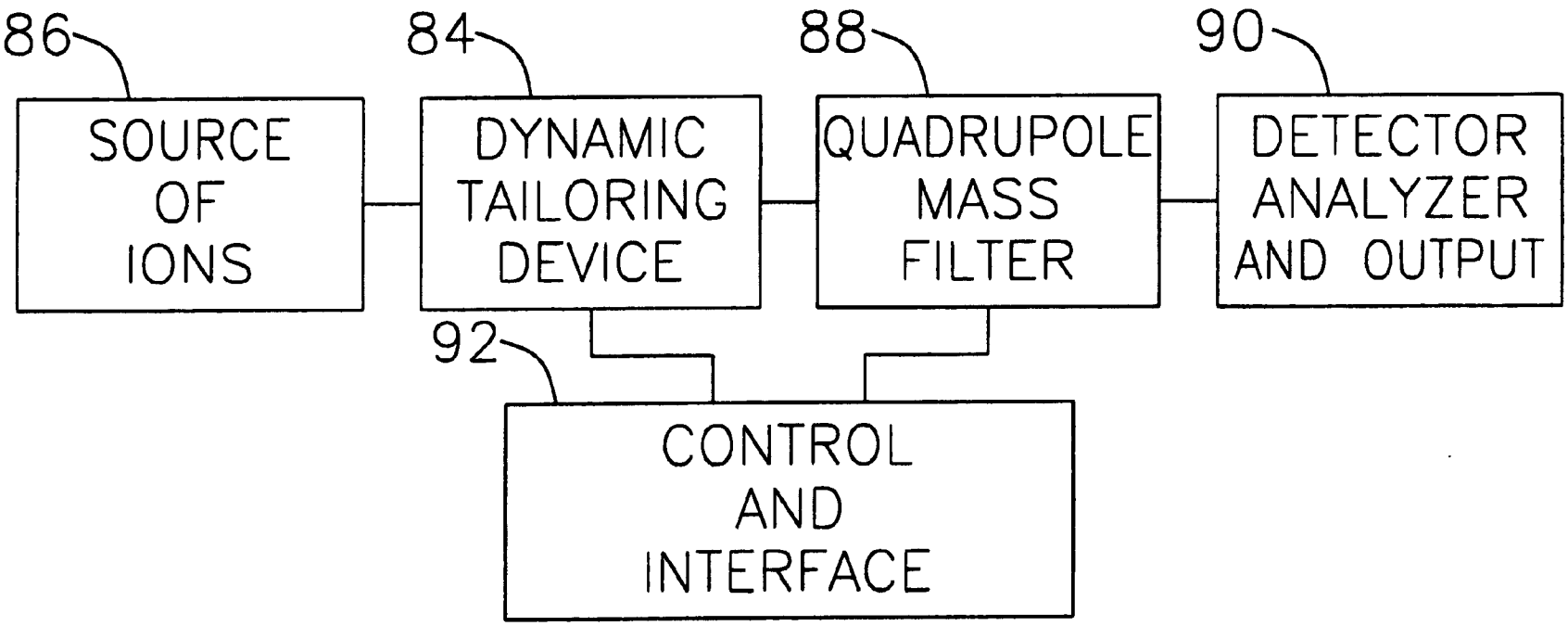
FIG. 2 is a block diagram representing a quadrupole mass filter spectrometer in accordance with one aspect of the present inventions.

In accordance with several aspects of the present inventions, means are provided in the form of a dynamic tailoring device for matching the ion distribution at the entrance of the quadrupole mass filter at a given point in time to increase the number of ions coming within the acceptance shape of the mass filter. The positions and/or velocities of the ions are preferably modified by the device so that the positions and velocities of the ions more closely match the phase space ellipse or other shape of the mass filter acceptance, and preferably do so over time so that the ion positions and velocities continue to match the mass filter acceptance over each cycle. In one preferred embodiment, a dynamic tailoring device 84 (FIG. 2), such as an ion optical element or entrance lens, is positioned between any source of ions 86 and a mass filter such as quadrupole mass filter 88. The quadrupole mass filter 88 transmits the selected ions to a detector, such as analyzer 90 for producing an appropriate output. Each of the elements of the spectrometer or other device incorporating the dynamic tailoring device and quadrupole mass filter may be controlled by, receive input from and produce output to a control and interface element or elements 92, conventional in the spectrometer industry. These may include microprocessors, memory units, displays and the like. The dynamic tailoring device 84 can be a single element or may be a plurality of elements, but in one preferred embodiment is a single entrance lens described more fully below in conjunction with FIG. 6. In one preferred embodiment, the dynamic tailoring device produces ions having a phase space configuration matching the quadrupole acceptance for the highest mass and best resolution desired, and is preferably done dynamically to account for the changing quadrupole acceptance over time. One or more aspects of the present inventions provide a means for dynamically matching the ion beam positions and velocities to the acceptance shape of the quadrupole mass filter as a function of RF phase.

In one preferred embodiment of the inventions, the dynamic tailoring device is an entrance lens 94 (FIG. 5) immediately adjacent the input of the quadrupole mass filter 40. The entrance lens 94 can be a plate 96 including a wall 98 defining an aperture 100, but other configurations are possible. The entrance lens can include a snout having a conical shape, a tubular shape (FIG. 6A) or an irregular cylindrical shape.

The quadrupole mass filter 40 is driven in the conventional manner by a quadrupole voltage supply 102 programmed or otherwise controlled to produce driving voltages $+/-[U+V\cos(\omega t)]$, where U is a DC offset voltage, and where V is the RF voltage varying at a frequency $\omega$ over time t. These relationships are well-known.

The entrance lens is coupled to a lens driver 104 for driving the entrance lens with the desired voltage so as to tailor the ion beam so that more ions have the desired phase-space relationship to match the acceptance of the quadrupole mass filter. Voltages are applied to the ion lens, or lenses, that vary with time over a cycle of the RF voltage applied to the quadrupole mass filter. The waveforms applied to the lenses preferably repeat every cycle and are thus periodic in fixed phase relation to the quad filter RF voltage. The lens driver 104 is coupled to a DC voltage supply 106 for providing a DC offset voltage to the entrance lens as determined by the lens driver 104. The lens driver 104 applies a voltage to the entrance lens 94, preferably according to the relation $Vo+(Vpp/2)\cos(\omega t+\phi)$, where Vo is the DC offset voltage for the entrance lens, and where Vpp is the peak to peak voltage of the RF signal applied to the entrance lens 94. The frequency ω is preferably the same as that for the quadrupole mass filter and ϕ is a phase offset relative to that of the RF voltage applied to the quadrupole mass filter, preferably phase coherent with it. The voltages Vo and Vpp, and the phase can be varied in practice independently of the quadrupole RF voltage, such as by a controller, so that ion transmission can be optimized for each mass and for each environment, such as equipment, and the like. The variability can occur during operation and even while the RF signal is changing during a cycle, especially, for example, where the system has data already incorporated into it that includes the voltage changes with mass, with time or with other operating conditions.

In the preferred embodiments, the driving voltage for the entrance lens varies over time, and the beam is tailored to match the acceptance of the quadrupole mass filter as that acceptance varies over time. A preferred method of doing so is to link, couple or otherwise relate the driving voltage for the entrance lens and the driving voltage for the quadrupole mass filter to each other, such as in a phase coherent manner, and one way would have them phase shifted and another way would have them phase locked. In one preferred embodiment, the lens driver 104 is linked to the quadrupole voltage supply 102 through a variable phase shift network 108 so the phase difference between the quadrupole mass filter voltage and the entrance lens voltage can be varied. The phase difference can be varied over the mass range to be scanned, varied to change the resolution, or varied to change the transmission of ions, among other reasons. The variable phase shift network 108 receives a signal representing a sinusoidal curve, Acos (ωt), and shifts the curve so that the output of the network 108 is Acos(ωt+ϕ). A suitable clock (not shown) controls the quadrupole voltage supply, the phase shift network and the lens driver, as would be apparent to one skilled in the art. The DC and RF voltage amplitudes can be varied as well, if desired.

Figure 5:
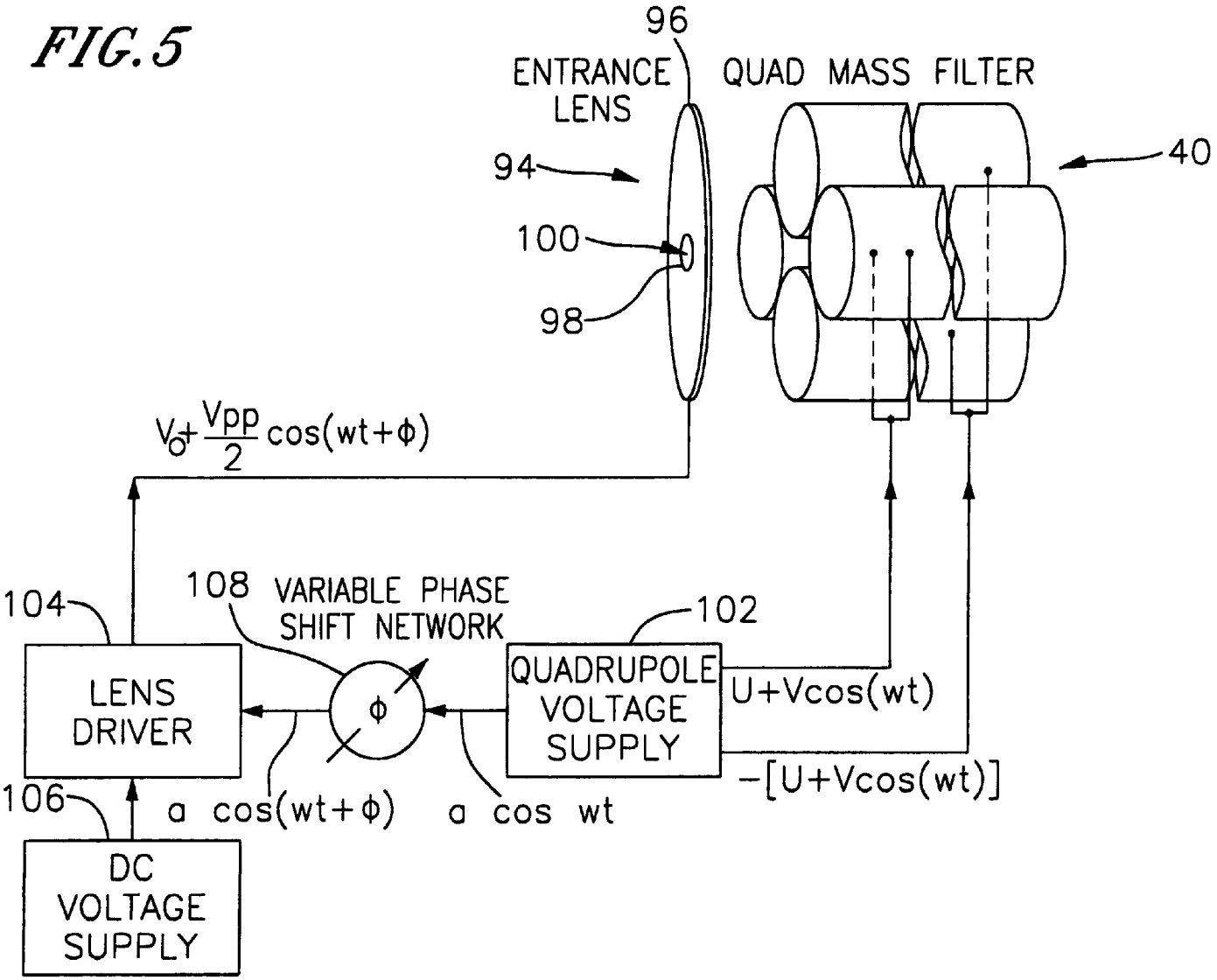
FIG. 5 is a schematic representation of a quadrupole mass filter and an entrance lens with their associated drivers in accordance with one aspect of the present inventions.
Figure 6:
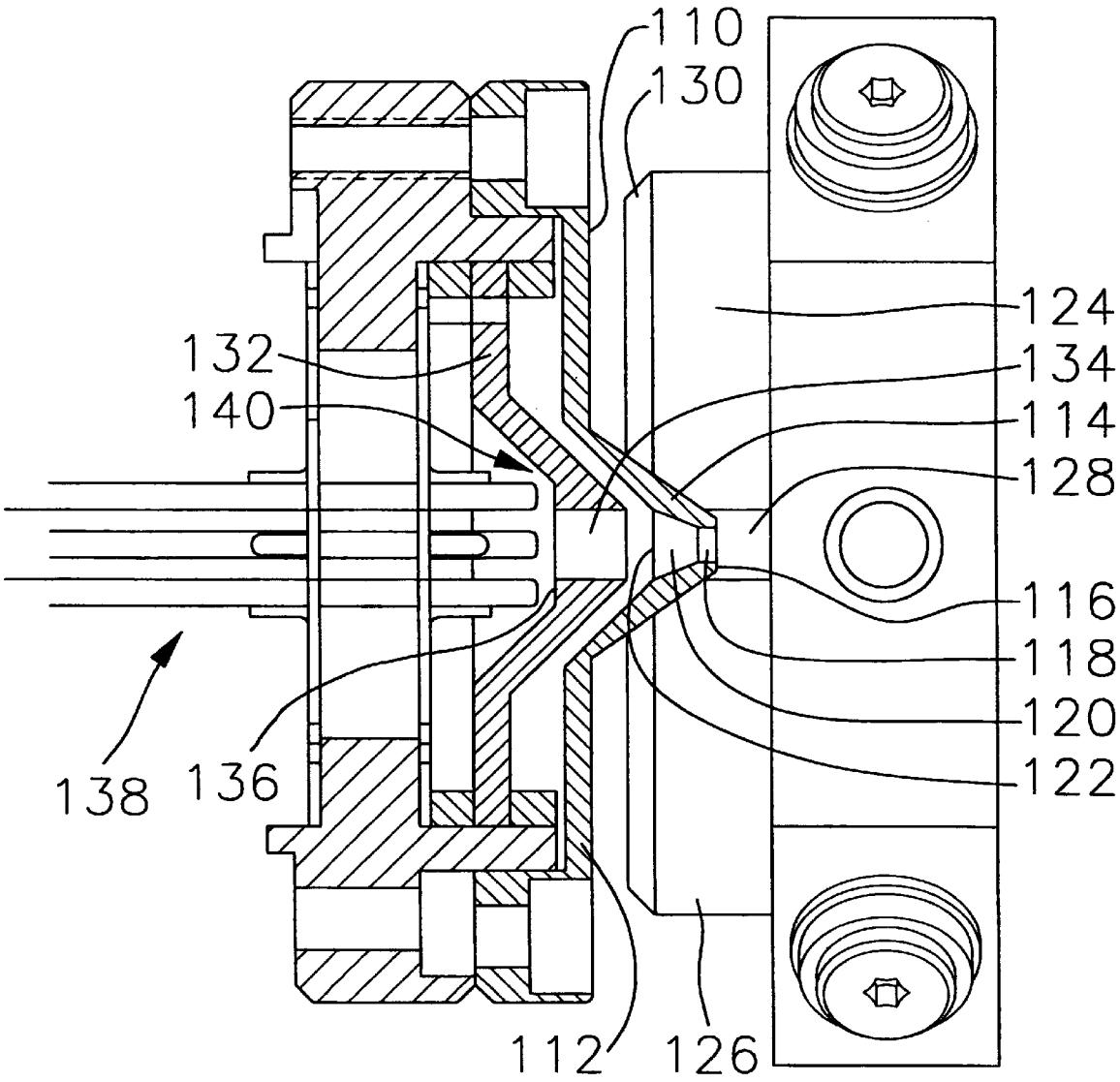
FIGS. 6 and 6A are detailed cross-sectional views of an entrance lens in accordance with a further aspect of the present inventions.

A quadrupole mass filter spectrometer has been modified to incorporate the system schematically depicted in FIG. 5 to include a conical-shaped entrance lens and a lens driver network phase coherent with or phase locked to the quadrupole voltage supply. Some of the ion optics and the entrance portion to a quadrupole mass filter are shown in FIG. 6 for a Hewlett-Packard G1946 (LC/MSD) quadrupole mass spectrometer with an electro-spray ion source. An entrance lens 110 includes a planar portion 112 and a converging, conical portion 114. The conical portion 114 extends into the entrance of the quadrupole mass filter, between the rods, to the forward most rim surface 116. The rim 116 defines the downstream edge of a substantially cylindrical bore 118 at the end of a frusto-conical bore 120 having an upstream edge 122. Three of the quadrupole rods are shown at 124, 126 and 128, each of which have tapered or chamferred end surfaces 130. A conically-shaped lens 132 nests within the upstream portion of the entrance lens portion 114, and includes a central bore 134 extending from a base wall 136 to the forward most surface of the lens. The multi-pole ion guide 138 extends into the lens 132 to a downstream end 140 spaced from wall 136.

The particular configurations of the dynamic tailoring device will vary depending on the mass spectrometer design and the other components that may be used in the ion optics. The voltage Vo, Vpp and the phase shift ϕ will vary according to the mass spectrometer configuration, the configuration of the dynamic tailoring device, the mass/charge ratios and the mass range to be scanned and the like. For the Hewlett-Packard G1946 spectrometer, the entrance lens 110, lens 132 and multi-pole ion guide 138 had the following dimensions to increase the abundance or transmission through the mass filter described in more detail below. The following dimensions are given in millimeters from the end 140 of the multi-pole ion guide 138. The distance to the base wall 136 is 0.56 mm, and to the downstream end of the bore 134 is 3.06 mm. The distance to the upstream end of the rods is 3.16 mm and to the upstream edge 122 of the bore 120 is 4.02 mm. The distance to the rim 116 is 6.46 mm. While these are exemplary dimensions, it is believed that other dimensions will also lead to comparable results.

Using the ion optics and the entrance lens configuration and dimensions described above, the following phase, voltages and results were obtained for different mass values:

TABLE 2

1 MHz Sine wave on "entrance" lens

| | Optimum phase (ns) | | | Optimum Vpp (V) | | | Abundance (Counts) | | | Peak Width, FWHM (AMU) | | |
|---|---|---|---|---|---|---|---|---|---|---|---|---|
| Mass | Vo = −3 | Vo = 0 | Avg | Vo = −3 | Vo = 0 | Avg | Baseline | Vo = −3 | Ratio | Baseline | Vo = −3 | delta |
| 118 | 356 | 368 | 362 | 92 | 69 | 81 | 60000 | 45000 | 0.8 | 0.71 | 0.76 | 0.05 |
| 322 | 368 | 432 | 400 | 128 | 73 | 100 | 87000 | 120000 | 1.4 | 0.73 | 0.72 | −0.01 |
| 622 | 364 | 340 | 352 | 144 | 132 | 138 | 70000 | 135000 | 1.9 | 0.76 | 0.76 | 0.00 |
| 922 | 304 | 296 | 300 | 175 | 166 | 171 | 74000 | 180000 | 2.4 | 0.74 | 0.74 | 0.00 |
| 1522 | 324 | 293 | 309 | 198 | 196 | 197 | 103000 | 240000 | 2.3 | 0.72 | 0.73 | 0.01 |
| 2122 | 284 | 296 | 290 | 255 | 244 | 250 | 141000 | 380000 | 2.7 | 0.71 | 0.67 | −0.04 |
| 2722 | 272 | 280 | 276 | 325 | 300 | 313 | 110000 | 280000 | 2.5 | 0.67 | 0.63 | −0.04 |

In the above Table 2, mass is given in AMU, the phase is measured in nanoseconds of cycle offset from an RF coupled measurement of the quadrupole RF, and the baseline refers to instrument performance without the phase coherent RF applied ("standard" mode). The table shows that the phase difference, peak to peak voltage and Vo can be adjusted with mass to give greater optimization. The "abundance" refers to the number of ion counts by the analyzer for the given mass, and the ratio refers to the number of counts with the modified spectrometer divided by the number of counts in standard mode. The abundance shows that the sensitivity of the device using the method of the inventions can increase by as much as two and ½ times. The peak width, full width at half maximum, shows that, even with greater sensitivity, the resolution can stay the same or improve, especially at higher masses. These results indicate that, with a continuous ion beam, applying a phase coherent RF to an entrance lens improves the matching of beam characteristics to quadrupole acceptance over a broad range of RF phases. This can be accomplished even with only one applied RF voltage, and even with a single added conductive element.

Figure 6A:
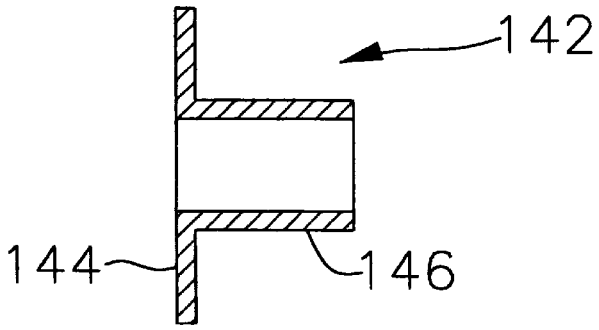

It is also believed that other entrance lens configurations would yield comparable results. For example, as shown in FIG. 6A, an entrance lens 142 may be formed from an apertured plate 144 by adding a snout 146 for extending toward or into the entrance to a quadrupole mass filter. The snout 146 may be tubular, conical, or may have an irregular cylindrical shape.

Other possible dimensions for the lens may be estimated from the relationship of the ion energy, ion travel distance the RF cycles applied. The fundamental relation between velocity and energy of an ion is:

$$v=1.4\times10^{6}(V/M)^{1/2}\text{ cm/sec},$$

where v=velocity of the ion in cm/sec;

v=energy of the ion in electron volts; and

M=mass of the ion in AMU.

For numerical examples, an RF frequency of 1 MHz is assumed. The time for a complete RF period will then be 1 microsecond ($10^{-6}$ sec). Thus, if l is the distance traveled in 1 usec:

TABLE 3

| M | V | l |
|---|---|---|
| 200 | 50 | 0.7 cm |
| 200 | 5 | 0.22 |
| 1000 | 100 | 0.44 |
| 500 | 2000 | 2.8 |
| 200 | 5000 | 7.0 |

These numerical examples give some perspective on the relationships between lens lengths and distances traveled by ions during an RF cycle, when the kinetic energy V of the ion is constant, i.e., in a field-free region. The actual distance traveled will be less if V represents peak potentials. In the embodiment shown in FIG. 6, for example, the distance from the upstream edge 122 to the forward-most rim surface 116 is 0.244 cm (2.44 mm). For an ion entering the lens at a phase such as to maximize its energy, the travel time through the lens would be about a half RF cycle, in representative cases inferred from data in Table 1. Although other travel time relationships (such as multiples of a half-cycle or non-integral ratios) are anticipated to result in at least some enhancement of mass spectrometer performance, the approximately half-cycle transit time is considered to be a desired embodiment. It is believed that an optimum range of transit times is in the range of about 0.05 RF cycle to about 5 RF cycles, and better in the range about 0.1 to about 1.5 RF cycles. These are ranges for the entrance lens embodiment, or other single-element lens embodiments.

In the embodiments that utilize multi-element lenses, described below, such as quadrupole doublets or triplets, it is advantageous to accelerate the ions to higher energies, such as the range 500–10,000 electron volts. Thus, it is preferred that the path length corresponding to an RF-cycle be of the order of several centimeters or more. However, it is understood that quadrupole lens devices can be made with element lengths in the range of 1–10 mm, so that the useful range of ion energy can be modest while still benefiting from one or more aspects of the present inventions. Total lengths of multi-element lenses can be in the range 3–100 mm, preferably 3–30 mm. After passing through the dynamic multi-element lens system, the ions are decelerated for introduction into the quadrupole mass filter. There also may be intermediate lenses with which to adjust focussing and defocusing resulting from acceleration/deceleration.

Figure 7:
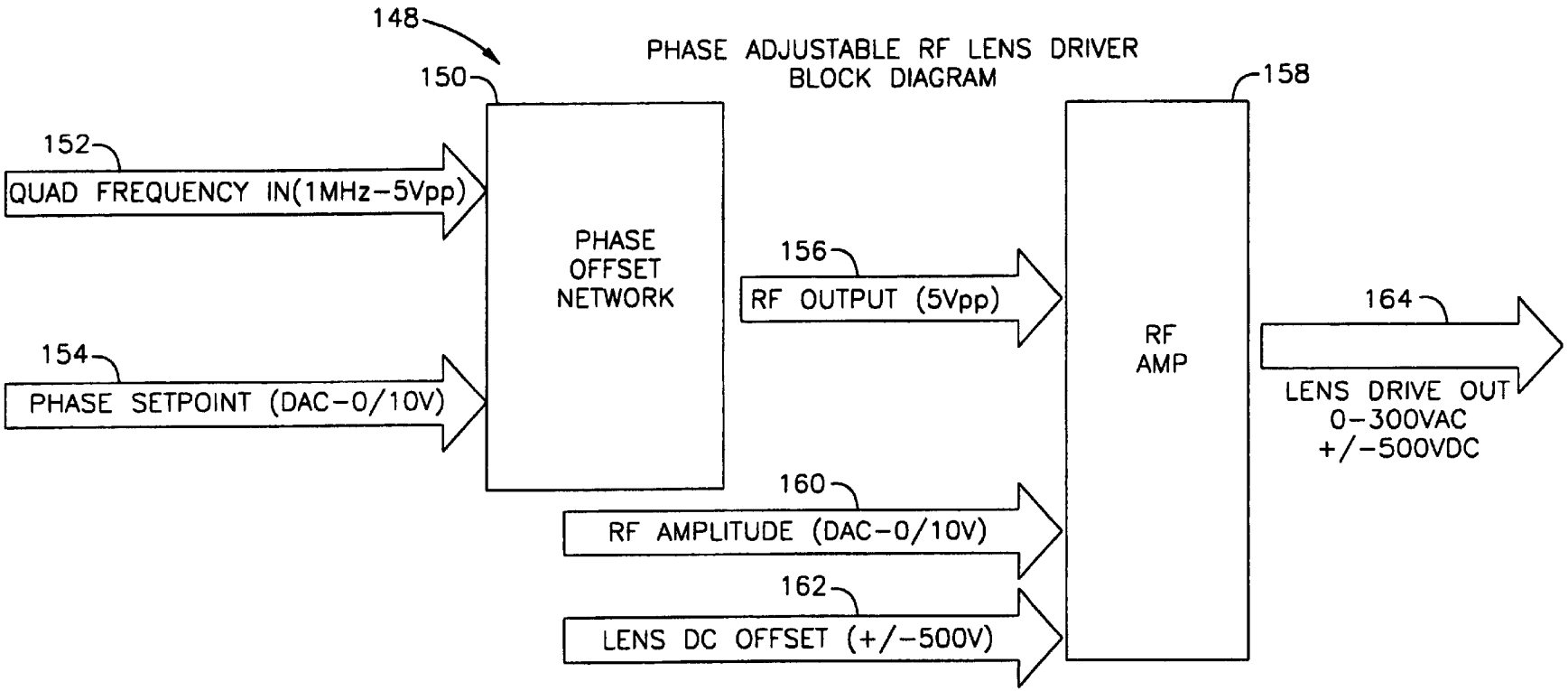
FIG. 7 is a block diagram of a control system for use with the filter and lens of FIG. 5.

An exemplary control system 148 for the dynamic lens is shown in FIG. 7. A phase offset network 150 receives the quadrupole frequency input 152 from the quadrupole voltage supply 102 and a phase set point 154 from a suitable controller. The set point may be stored in memory based on empirical values determined for the particular configuration of spectrometer for the mass values to be scanned. The phase offset network 150 provides an RF output 156 of a peak to peak voltage to an RF amplifier 158. The RF amplifier 158 also receives an RF amplitude setting 160 through a digital to analog converter. The RF amplitude setting may also be stored in memory as digital values and output to the digital to analog converter. The RF amplitude is calculated based on the selected mass, the frequency from the quadrupole mass filter, the time and the phase offset. The digital values may also be determined empirically based on the masses under consideration, the spectrometer configurations, and the like. A lens DC offset 162 is also provided to the RF amplifier 158, to be combined with the RF amplitude information and multiplied by the RF output 156 to give the lens drive output voltage 164 to be applied to the entrance lens 94, 110.

The results represented by Table 2 are graphically shown in FIGS. 8–11. The data show that the optimum RF phase (FIG. 10), in nanoseconds, may change with mass. In the configuration tested, the optimum RF phase difference 166 changed with mass from about 411 to about 265, between zero and 3000 AMU. One equation fitting the data is y=411−2.65 sqrt (x). This indicates that the optimum RF phase difference changes roughly as the square root of the mass, if the beam is approximately a fixed uniform energy with velocity proportional to the square root of energy. The transit time of an ion and the phase shift will be proportional to the velocity and to the square root of mass. Alternatively, the beam convergence and divergence change with velocity and would be proportional to the square root of mass as well. Phase shift may need to be changed with mass in a typical application.

Figure 11:
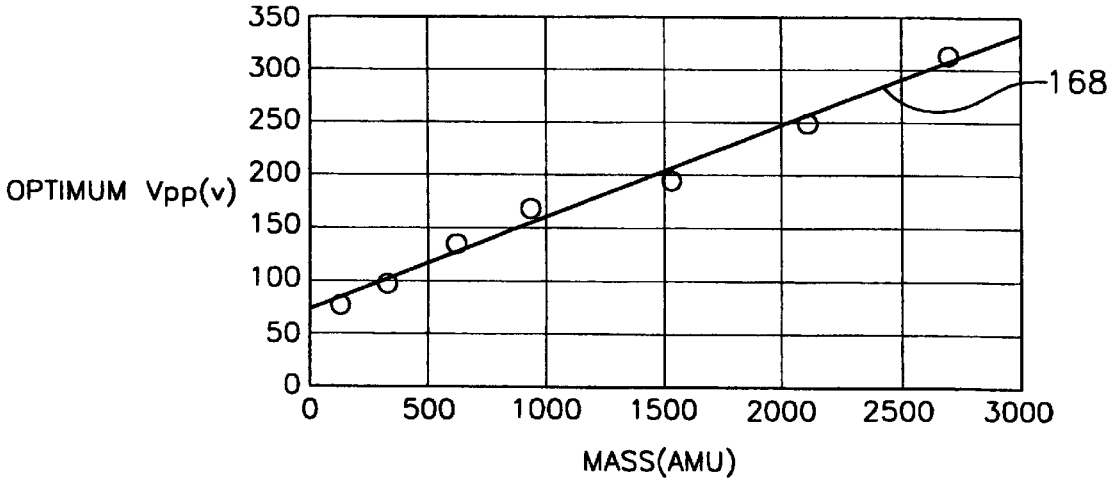
FIG. 11 is a graphical representation of the optimum peak-to-peak voltage as a function of mass in one application of the present inventions.

The optimum peak to peak voltage was found to have a linear relation 168 to mass. As shown in FIG. 11, the optimum changed from about 77 to about 325 volts, giving the equation $$y=77.5+0.085x.$$

This voltage appears to be proportional to mass.

Figure 8:
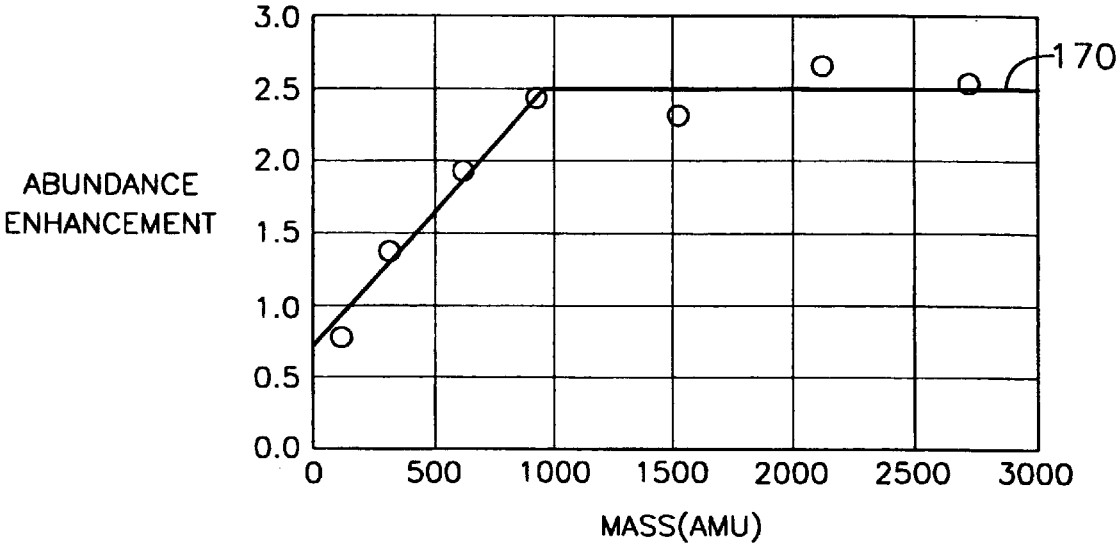
FIG. 8 is a graphical representation of the enhancement of the abundance in one application of the present inventions as a function of mass.

FIG. 8 shows the ratio 170 of signal strength using the system described above compared to that in standard mode. There results were obtained for Vo=−3 throughout. The data indicate that this value for Vo is optimum for masses greater than 600 AMU but may be sub-optimal for lower masses. Thus, it is preferred that Vo would be varied as a function of the mass/charge of interest, e.g., during a mass spectrum scan.

Figure 9:
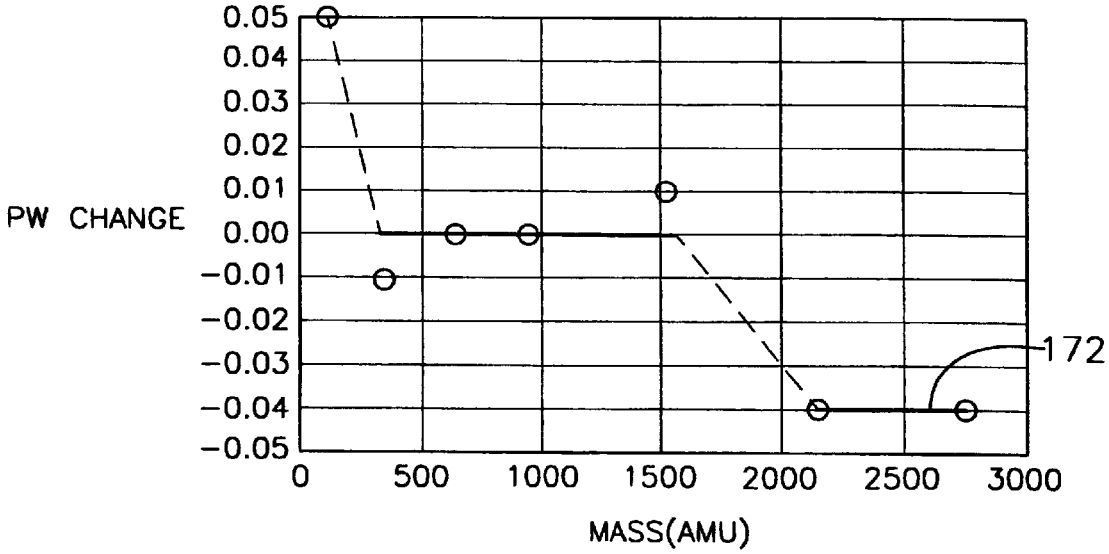
FIG. 9 is a graphical representation of the enhancement of the resolution in one application of the present inventions as a function of mass.
Figure 10:
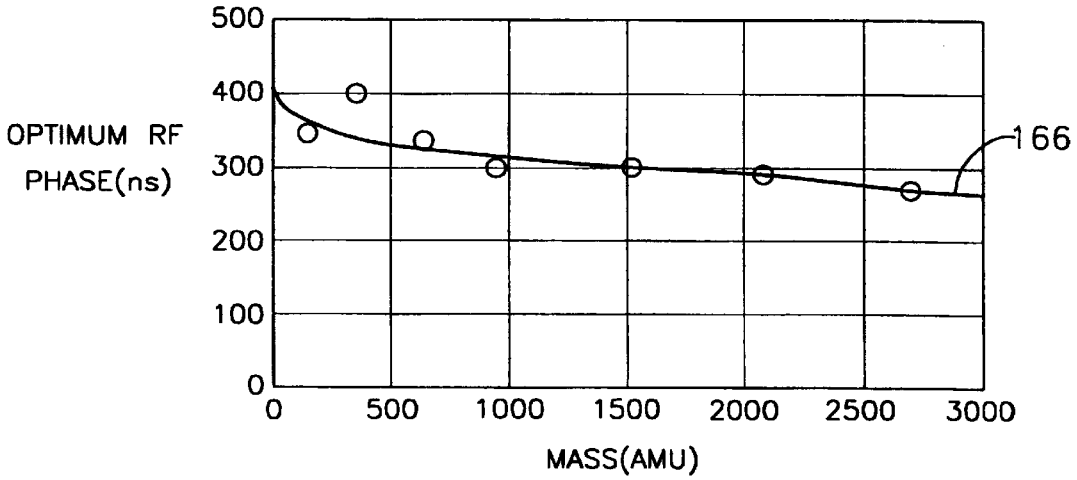
FIG. 10 is a graphical representation of optimum phases in one application of the present inventions as a function of mass.

FIG. 9 depicts the data 172 representing change in resolution. The negative values represent higher resolution. Changes of plus or minus 0.03 are considered significant, and all masses have nominal resolution of M/0.75. Significant improvements can be had at higher masses, because significantly smaller acceptance for higher resolutions obtained a greater benefit from acceptance matching. As with FIG. 8, Vo was not properly optimized for lower masses.

Figure 12:
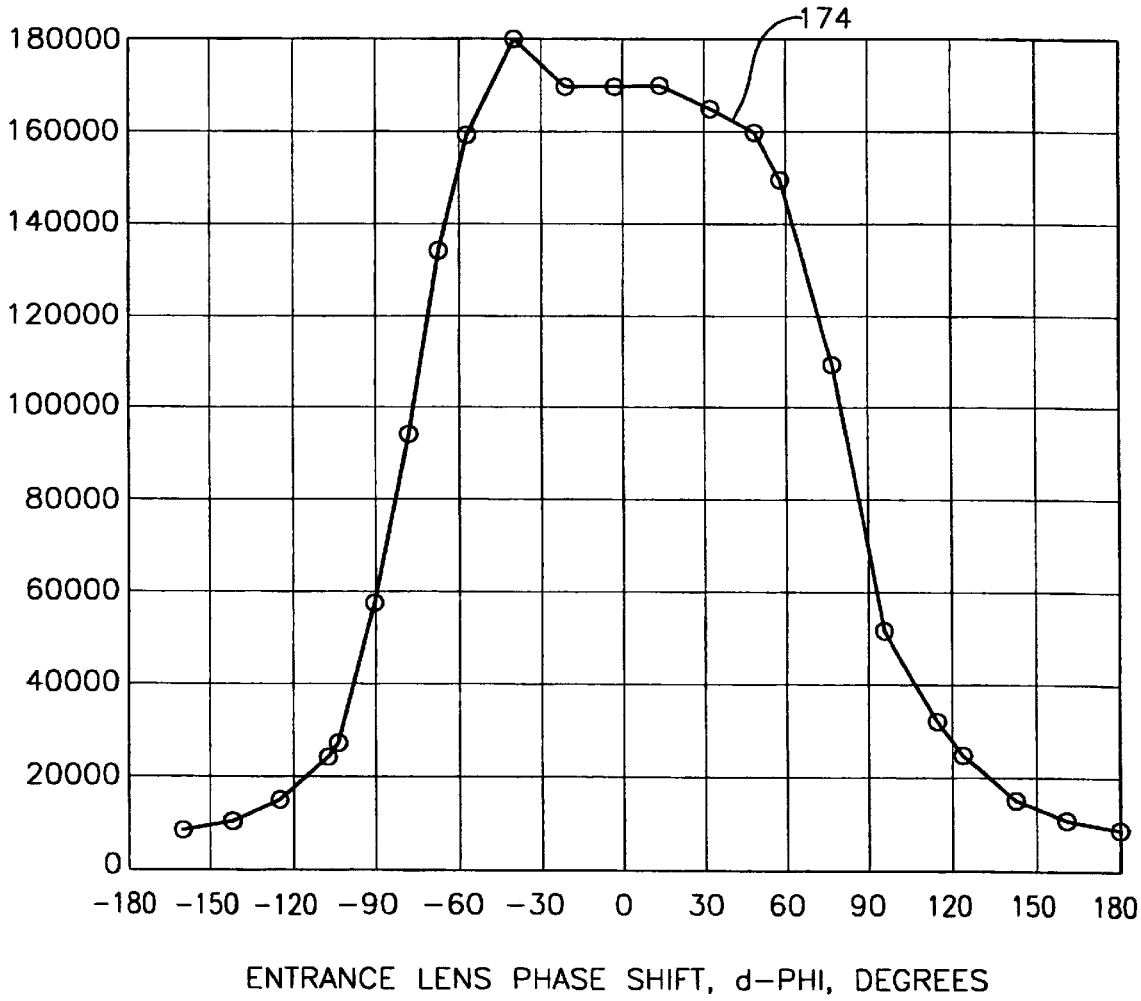
FIG. 12 is a graphical representation of an enhanced transmission in one application of the present inventions as a function of phase difference between the voltage applied to the quadrupole mass filter and the voltage applied to the entrance lens.

FIG. 12 shows the effect of RF phase shift to lens on signal strength for a mass to charge ratio of 922 at a fixed Vo=0. In FIG. 12, the zero of phase has been chosen arbitrarily and the values shown thus differ by a constant amount from the actual phase shifts with respect to the quadrupole driver waveform. The phase values are not based on the data in Table 2, which are also expressed in different units. The curve 174 shows that, with all other parameters being constant, the phase shift for the entrance lens affects the signal strength of the spectrometer.

Other dynamic tailoring devices can be used to improve the resolution and/or transmission in mass spectrometers. One preferred embodiment from the point of view of maximum sensitivity increase would use multiple lenses, for example, an einzel lens followed by a quadrupole doublet or triplet. Quadrupole lenses may be desirable because the x- and y-coordinates of the ions should be manipulated independently with respect to their divergence or convergence. The system could also use waveform synthesis (phase coherent with the quadrupole mass filter RF voltage) to produce the dynamic voltages applied to the lenses. For greater effectiveness, the waveforms are preferably designed for the particular physical arrangement including the quadrupole fringing fields.

Figure 13:
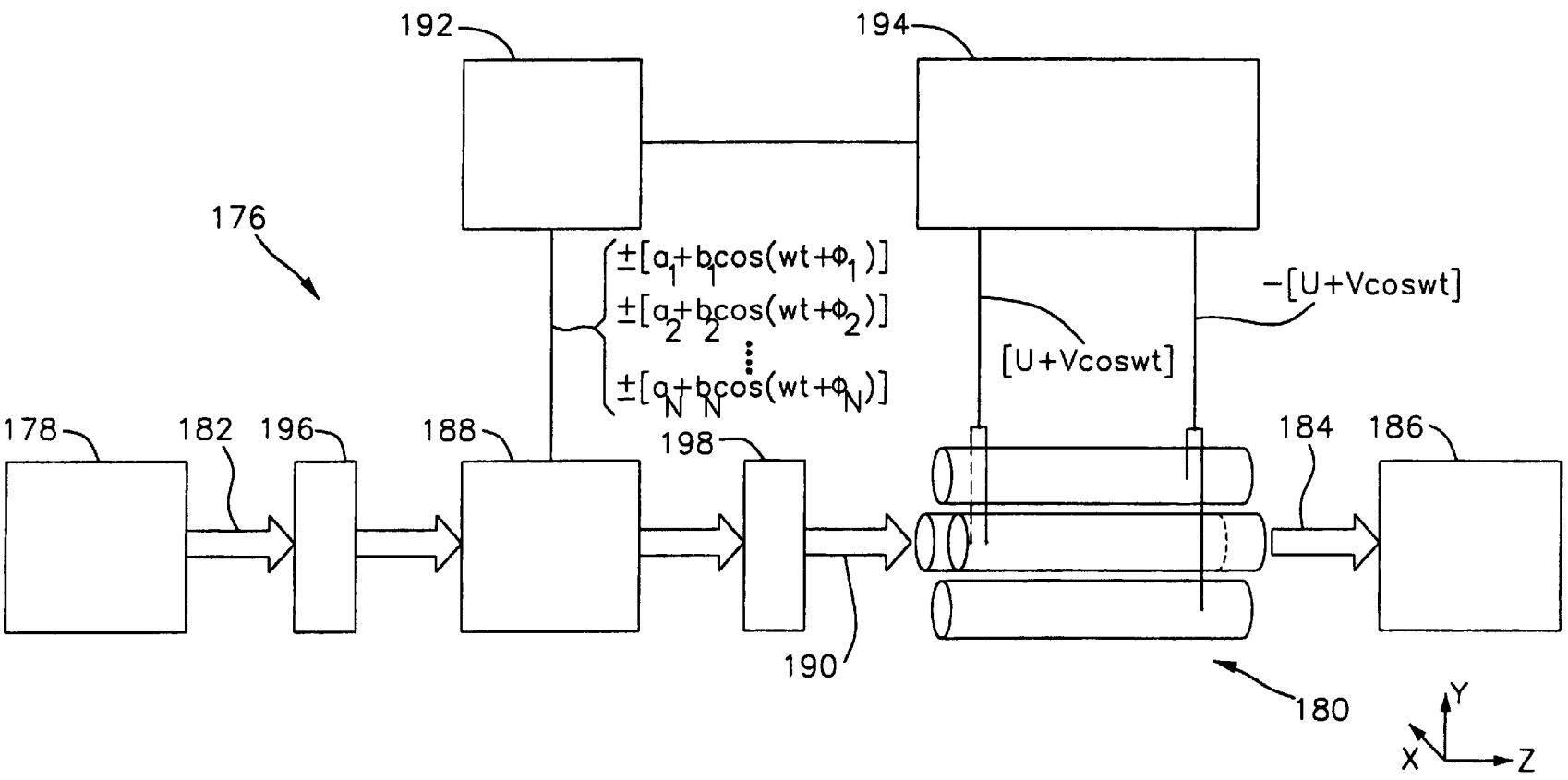
FIG. 13 is a schematic representation of a further embodiment of an ion optical element accordance with a further aspect of one of the present inventions.

In one preferred embodiment, a quadrupole lens system 176 (FIG. 13) may be used between a source of ions 178 and a quadrupole mass filter 180. The ion beam 182 ejected from the source of ions 178 is tailored before entering the quadrupole mass filter 180, and the ions 184 transmitted by the filter 180 are picked up by the detector 186. The quadrupole lens system 176 may include one or more quadrupole lenses 188, which may include a doublet of two quadrupole lenses of opposite polarity or a triplet of three quadrupole lenses. Quadrupole lenses are discussed in Wollnik, Hermann, "Optics of Charged Particles", Chapter 3, Academic Press, 1987, incorporated herein by reference. Numerical examples are also given, for example at pp. 82–85, and the example on p. 85 corresponding to V=3000 eV (electron Volts) allows element lengths that are acceptable. Other lens configurations are also possible. Each of the quadrupole lenses would be driven with one or more voltages sufficient to tailor the ion beam 190 to more closely match the acceptance to the quadrupole mass filter. The system includes a lens driver 192 preferably phase coherent with the voltages applied to the quadrupole mass filter 180 by the filter voltage driver 194. In a preferred embodiment, the quadrupole lens 188 is preceded by an accelerating lens system 196, and followed by a decelerating lens system 198.

In addition to the preferred embodiments discussed, the present inventions may have particularly beneficial application to quadrupole mass filters operating in stability zones or regions other than the first region, in which many quadrupole mass filters presently operate. In the first region, given by one of the solutions to the well-known Matheiu equation (see, Dawson, FIG. 2.9), ion energies are generally lower for a given mass, and the quadrupole acceptance is generally larger than that for the other regions. In other regions, such as the "second" or "intermediate" region where a =2.8 and q=3.0, approximately, higher voltages are used, which often leads to higher resolution, and the quadrupole acceptance is generally smaller. Consequently, one or more aspects of the present inventions can be used with what is believed to be additional benefit to mass filters operating in the second or other regions. Where the quadrupole acceptance is smaller, using a lens or other upstream system to account for changes in phase in the quadrupole will increase the resolution and/or sensitivity of the analyzer by tailoring the ion beam to account for the changing quadrupole acceptance over time.

In addition to waveforms periodic with the quadrupole RF voltage, the lens voltage or voltages can be superposed with voltages that change with a much longer period, namely that corresponding to a scan of the instrument over the mass range of interest. This may be used, for example, in order to correct for changes in acceptance conditions with ion mass. With some ion beams, such as those originating in electron impact ionization sources, ion energy does not vary with mass, so that the velocities are inversely proportional to the square root of the mass. The transit time from the lens system to the quad will be longer for ions of higher mass, in which case a phase correction may be desirable. With other ion beams, such as beams from supersonic sources, the ions all have the same velocity, independent of the mass, and ion transit times are essentially independent of mass. Focusing conditions may also be changed as a function of mass of interest, and this can be done dynamically with the scan.

Figure 14:
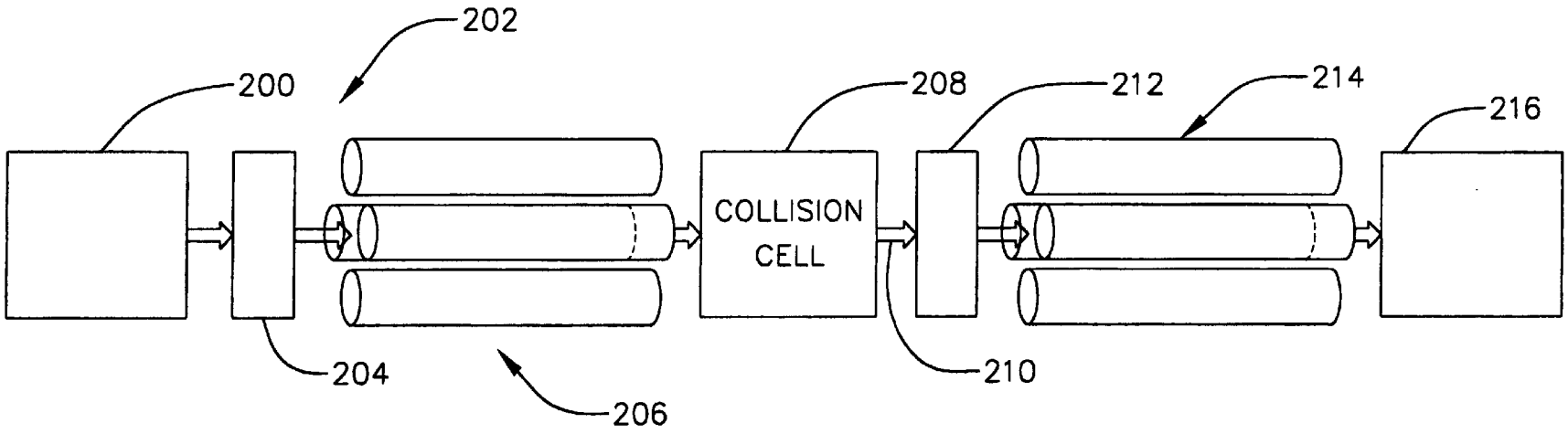
FIG. 14 is a schematic representation of a further embodiment of a mass spectrometer in accordance with a further aspect of one of the present inventions.

The lens systems described herein can be used with a number of different apparatus both upstream and downstream from the lens system. For example, the lens system can be used with and as part of a triple quadrupole or tandem mass spectrometer (MS/MS), as shown in FIG. 14. The lens system can be positioned at the output of the collision cell, and an embodiment of the lens systems can be incorporated in the upstream mass filter. As shown in FIG. 14, an ion source 200 produces ions to the input of a mass filter assembly 202, which may include, for example, an entrance lens 204 and a conventional quadrupole mass filter 206. The entrance lens 204 may be a conventional entrance lens or an entrance lens such as one of those described here, having an RF and DC voltage applied that is phase coherent with or phase locked to the RF of the quadrupole lens. A collision cell 208 accepts ions from the filter 206, in the conventional manner and produces ions 210 at an output. The ions enter an entrance lens 212, configured in accordance with one of the entrance lens designs of the present inventions, which then inputs them into a quadrupole mass filter 214. The entrance lens 212 has an RF voltage applied that is phase coherent with the RF of the quadrupole mass filter 214, and a DC voltage, in the manner previously described. An ion pickup detects the ions that are passed through the quadrupole mass filter 214, and is configured to operate in the conventional manner. Other applications of the lens systems can be made, beyond as part of a source of ions or as an input to a quadrupole mass filter.

The lens systems of the present inventions operate with many different types of quadrupole input optics, and they can be retrofit to existing equipment. They can also operate with a number of different waveforms. The lens systems provide a higher resolution for a given transmission, and/or a higher transmission for a given resolution. The benefits are especially pronounced at higher ion masses.

Having thus described several exemplary implementations of the invention, it will be apparent that various alterations and modifications can be made without departing from the inventions or the concepts discussed herein. Such operations and modifications, though not expressly described above, are nonetheless intended and implied to be within the spirit and scope of the inventions. Accordingly, the foregoing description is intended to be illustrative only.

What is claimed is:

1. A mass spectrometer comprising:

a source of ions;

a mass filter having an input and an output adjacent the source of ions;

a voltage supply coupled to the mass filter for applying a radio frequency voltage to the mass filter and for operating at at least one selected frequency;

an ion optical element adjacent the input of the mass filter; and a voltage supply coupled to the ion optical element for supplying a radio frequency voltage to the ion optical element that is phase coherent with the radio frequency voltage applied to the mass filter and for supplying a DC voltage.

2. The mass spectrometer of claim 1 wherein the mass filter is a quadrupole mass filter.

3. The mass spectrometer of claim 1 wherein the ion optical element is an entrance lens.

4. The mass spectrometer of claim 3 wherein the entrance lens extends at least partly into the quadrupole mass filter.

5. The mass spectrometer of claim 4 wherein the entrance lens includes a conical shape.

6. The mass spectrometer of claim 4 wherein the entrance lens includes a cylindrical shape.

7. The mass spectrometer of claim 6 wherein the entrance lens includes a right circular cylindrical shape.

8. The mass spectrometer of claim 4 wherein the entrance lens includes a tubular shape.

9. The mass spectrometer of claim 4 wherein the entrance lens includes a relatively flat plate and a wall defining an aperture in the plate for allowing ions to pass through the aperture in the plate and is formed by a single conductive element.

10. The mass spectrometer of claim 1 wherein the voltage applied to the ion optical element is a voltage including a DC voltage and a time varying voltage.

11. The mass spectrometer of claim 10 wherein the time varying voltage varies with the voltage applied to the quadrupole mass filter.

12. The mass spectrometer of claim 11 wherein the time varying voltage applied to the ion optic element has the same frequency as the voltage applied to the quadrupole mass filter.

13. The mass spectrometer of claim 1 wherein the voltage applied to the ion optical element varies with mass.

14. The mass spectrometer of claim 13 wherein the voltage applied to the ion optical element is a voltage including a DC voltage and a time varying voltage and wherein the DC voltage varies with mass.

15. The mass spectrometer of claim 13 wherein the voltage applied to the ion optical element is a voltage including a DC voltage and a time varying voltage and wherein the time varying voltage varies with mass.

16. The mass spectrometer of claim 1 wherein the phase of the voltage applied to the ion optical element varies with mass.

17. The mass spectrometer of claim 16 wherein the voltage applied to the ion optical element is a voltage including a DC voltage and a time varying voltage and wherein the time varying voltage has a phase that varies with mass.

18. The mass spectrometer of claim 1 wherein the source of ions is an ion collision cell.

19. The mass spectrometer of claim 1 wherein the voltage applied to the ion optical element varies with mass.

20. A quadrupole mass spectrometer comprising:

a quadrupole mass filter having an input and an output;

a voltage supply coupled to the mass filter for applying a radio frequency voltage to the mass filter and for operating at at least one selected frequency;

an ion changing element adjacent the quadrupole mass filter for changing at least one of the beam position and velocity of an ion; and a voltage supply coupled to the ion changing element for supplying a radio frequency voltage to the ion changing element that is phase coherent with the radio frequency voltage applied to the mass filter and for supplying a DC voltage.

21. The quadrupole mass spectrometer of claim 20 wherein the ion changing element is a quadrupole lens.

22. The quadrupole mass spectrometer of claim 21 wherein the quadrupole lens is a quadrupole doublet.

23. The quadrupole mass spectrometer of claim 21 wherein the quadrupole lens is a quadrupole triplet.

24. The quadrupole mass spectrometer of claim 21 further including an accelerating lens.

25. The quadrupole mass spectrometer of claim 24 further including a decelerating lens.

26. A quadrupole mass spectrometer comprising:

a source of ions;

a quadrupole mass filter having an input and an output adjacent the source of ions;

a first voltage supply coupled to the quadrupole mass filter for applying a radio frequency voltage to the quadrupole mass filter and for operating at at least one selected frequency;

an entrance lens having a conical shape extending into the input of the quadrupole mass filter for changing at least one of the beam position and velocity; and a second voltage supply coupled to the entrance lens for supplying a radio frequency voltage to the entrance lens that is phase coherent with the radio frequency voltage applied to the quadrupole mass filter.

27. The quadrupole mass spectrometer of claim 26 further comprising a first voltage control for the first voltage supply and a second voltage control for the second voltage supply for controlling the voltages applied to the quadrupole mass filter and to the entrance lens, respectively, as a function of mass.

28. The quadrupole mass spectrometer of claim 27 wherein the second voltage control can operate to control the voltage applied to the entrance lens differently relative to the first voltage control.

29. A method of operating a mass spectrometer having a mass filter with an input and an output, a voltage supply coupled to the mass filter for applying a radio frequency voltage to the mass filter, an ion optical element adjacent the input and a voltage supply coupled to the ion optical element for supplying a radio frequency voltage to the ion optical element, the method comprising the steps of:

applying a mass filter radio frequency voltage to the mass filter; and applying a radio frequency voltage to the ion optical element wherein the radio frequency voltage for the ion optical element is phase coherent with the radio frequency voltage applied to the mass filter.

30. The method of operating a mass spectrometer of claim 29 wherein the step of applying a radio frequency voltage to the ion optical element includes the step of varying the magnitude of the radio frequency voltage as a function of mass.

31. The method of operating a mass spectrometer of claim 29 wherein the step of applying a radio frequency voltage to the ion optical element includes the step of applying a DC voltage to the ion optical element and wherein the step of applying the DC voltage includes the step of varying the magnitude of the DC voltage as a function of mass.

32. The method of operating a mass spectrometer of claim 29 wherein the step of applying a radio frequency voltage to the ion optical element includes the step of varying the phase of the radio frequency voltage as a function of mass.

33. The method of operating a mass spectrometer of claim 32 wherein the step of varying the phase of the radio frequency voltage as a function of mass includes the step of varying a phase shift of the radio frequency voltage applied to the ion optical element from the radio frequency voltage applied to the mass filter.

34. The method of operating a mass spectrometer of claim 29 further comprising the step of varying the radio frequency voltage applied to the ion optical element as a function of data representing RF amplitude as a function of mass.

35. The method of operating a mass spectrometer of claim 29 further comprising the step of varying the radio frequency voltage applied to the ion optical element as a function of data representing lens DC offset as a function of mass.

36. The method of operating a mass spectrometer of claim 29 further comprising the step of varying the radio frequency voltage applied to the ion optical element as a function of data representing phase setpoint as a function of mass.

37. The method of operating a mass spectrometer of claim 29 further comprising the step of controlling a phase offset network to vary the phase of the radio frequency voltage applied to the ion optical element.

38. The method of operating a mass spectrometer of claim 29 further comprising the step of supplying ions to the ion optical element from a collision cell.

39. The method of operating a mass spectrometer of claim 29 wherein the step of applying a radio frequency voltage to an ion optical element includes the step of applying a radio frequency voltage to a quadrupole lens.

40. The method of operating a mass spectrometer of claim 39 further comprising the step of applying a voltage to an accelerating lens.

41. The method of operating a mass spectrometer of claim 29 wherein the step of applying a radio frequency voltage to an ion optical element includes the step of applying a radio frequency voltage to at least one quadrupole of a plurality of quadrupole lenses.

42. The method of operating a mass spectrometer of claim 29 wherein the step of applying a radio frequency voltage to an ion optical element includes the step of applying a radio frequency voltage that is phase locked with the radio frequency voltage applied to the mass filter.

43. A mass spectrometer comprising:

a source of ions;

a mass filter having an input and an output adjacent the source of ions;

a voltage supply coupled to the mass filter for applying a radio frequency voltage to the mass filter and for operating at at least one selected frequency;

an ion optical element formed from a single conductive element and positioned adjacent the input of the mass filter; and a voltage supply coupled to the ion optical element for supplying a radio frequency voltage to the ion optical element that is phase coherent with the radio frequency voltage applied to the mass filter and for supplying a DC voltage.

44. The mass spectrometer of claim 43 wherein the ion optical element is an entrance lens.

45. The mass spectrometer of claim 44 wherein the entrance lens extends at least partly into the quadrupole mass filter.

46. The mass spectrometer of claim 45 wherein the entrance lens includes a conical shape.

47. The mass spectrometer of claim 43 wherein the voltage applied to the ion optical element is a voltage including a DC voltage and a time varying voltage.

48. The mass spectrometer of claim 47 wherein the time varying voltage varies with the voltage applied to the quadrupole mass filter.

49. The mass spectrometer of claim 43 wherein the voltage applied to the ion optical element is a voltage including a DC voltage and a time varying voltage and wherein the DC voltage varies with mass.

* * * * *